US006109468A

United States Patent [19]

Kneer

[11] Patent Number: 6,109,468

[45] Date of Patent: Aug. 29, 2000

[54] CONTAINER WITH PRESSURE COMPENSATION HOLES

[75] Inventor: Roland Kneer, Farchant, Germany

[73] Assignee: Gaplast GmbH, Germany

[21] Appl. No.: 09/202,916

[22] PCT Filed: Jun. 27, 1997

[86] PCT No.: PCT/DE97/01348

§ 371 Date: Dec. 30, 1998

§ 102(e) Date: Dec. 30, 1998

[87] PCT Pub. No.: WO98/01366

PCT Pub. Date: Jan. 15, 1998

[30] Foreign Application Priority Data

Jul. 4, 1996 [DE] Germany ..... 196 26 968

[51] Int. Cl.[7] ..... B65D 90/02

[52] U.S. Cl. ..... 215/378; 215/385; 215/902; 220/62.21

[58] Field of Search ..... 220/62.21; 215/378, 215/385, 379, 902

[56] References Cited

U.S. PATENT DOCUMENTS 2,743,038 4/1956 Ferries .

FOREIGN PATENT DOCUMENTS 0182094 5/1986 European Pat. Off. .
0550772 7/1993 European Pat. Off. .
0759399 2/1997 European Pat. Off. .
8437419 3/1985 Germany .
4139555 3/1993 Germany .

*Primary Examiner*—Joseph M. Moy
*Attorney, Agent, or Firm*—Pyle & Piontek

[57] ABSTRACT

The receptacle is produced in a coextrusion-type blow molding process and consists of a stiff outer receptacle and an easily deformable inner bag which are made from respectively different thermoplastic materials that do not form a welded joint with one another. The bottom weld seam of the inner bag is clamped in a closed bottom web of the outer receptacle. The pressure compensating openings are offset by about 90° with respect to the plane passing through the bottom weld seam and the longitudinal center axis of the receptacle, whereby the inner bag is only contracted at two sides when the receptacle contents is discharged. The negative pressure prevailing inside the inner bag is thereby reduced.

5 Claims, 2 Drawing Sheets

CONTAINER WITH PRESSURE COMPENSATION HOLES

The present invention relates to a receptacle produced in a coextrusion-type blow molding process, which consists of a substantially stiff outer receptacle and an easily deformable inner bag which are made from respectively different thermoplastic materials that do not form a welded joint with one another, said receptacle comprising a receptacle opening and at least two pressure compensating openings provided in the wall of the outer receptacle for pressure compensation within the space existing between the outer receptacle and the inner bag upon contraction of the inner bag, wherein, when excess material is squeezed off at the bottom of the blow mold, the inner bag is closed by a bottom weld seam and said bottom weld seam is clamped into the bottom of the outer receptacle which is also closed.

Such a receptacle is described in DE 41 39 55 C2. In this known receptacle, the bottom of the outer receptacle has formed thereon an outwardly projecting web in which, while the blow mold is being closed, material of the outer receptacle is united as the material of the inner bag recedes inwards from the squeeze-off edge due to an impact pressure b uilt up in the area of the protruding Web. As a consequence, material of the outer receptacle contacts itself over part of the height of the aforementioned web, resulting in the formation of a closed weld seam. The bottom weld seam of the inner bag is anchored in the adjoining area of the web. The web can, for example, have an approximately kite-shaped cross-sectional form, but other cross-sectional shapes of the web, for example arched ones, will also yield a welded bottom seam of the outer receptacle. As for further details regarding the production of the prior-art receptacle, reference is made to DE 41 39 555 C2.

However, the bottom weld seam of the inner bag can also be secured in a different way to the bottom of the outer receptacle, for instance by means of suitable slides in the blow mold.

In the prior-art receptacle, the pressure compensating openings on the outer receptacle are formed in that the tube-shaped blank is squeezed off in the shoulder portion while the blow mold is being closed, with the material being smoothly squeezed off without the formation of a projecting web, so that the two material layers of the outer receptacle do not contact each other as such a contact is prevented by the interposed double layer of the inner bag. As a result, in the prior-art receptacle, two unwelded seams are formed in the shoulder portion in the outer receptacle, the seams extending from the shoulder portion up to the neck portion.

When viewed in the circumferential direction of the receptacle, these pressure compensating openings at both sides are positioned at locations which are aligned with the points of intersection of the bottom weld seam with the circumferential seam of the receptacle. In other words, these pressure compensating openings are located in circumferential direction on the lines of intersection of a plane passing through the central longitudinal axis of the receptacle and the bottom seam, with the circumferential wall of the receptacle.

Insofar as points of intersection of the bottom weld seam with the circumferential wall have been mentioned above, such a design also covers a case where the bottom weld seam does not extend over the whole diameter of the receptacle, whereby in such a case the points of intersection are formed by a line which extends the bottom weld seam.

Upon discharge of the receptacle contents, for example by means of a pump, the volume of the inner bag is reduced, and air exits for the purpose of pressure compensation from the surroundings of the receptacle into the space existing between inner bag and outer receptacle. A certain negative pressure or vacuum which keeps the inner bag in its contracted state always remains in the receptacle.

In the prior-art receptacle, the inner bag, when viewed in horizontal section, i.e. in a plane perpendicular to the longitudinal axis of the receptacle, will contract substantially in star-shaped configuration when the receptacle contents is discharged. This means that the inner bag will detach from the outer receptacle at four locations that are substantially opposite to one another in pairs, namely, when viewed in circumferential direction, at the pressure compensating openings and on the circumferential portions which are respectively offset by 90° with respect thereto. With an increasing contraction the four detached portions are also increasing, resulting approximately in the above-mentioned star-shaped configuration.

Such a contraction at four sides of the inner bag has the effect that a relatively great negative pressure or vacuum is created in the inner bag, i.e. of course irrespective of the fact that ambient air enters into the space between outer receptacle and inner bag through the pressure compensating openings; in other words, a relatively great collapsing force is required for creating said star-shaped contraction and for maintaining the same.

However, the greater the negative pressure inside the inner bag is, the greater is the permeation through the wall of the inner bag and the risk of leakage. Permeation might impair the quality of the receptacle contents, while in case of leakage caused by air entering into the bag the pump might become inoperative or the receptacle contents might spill.

It is the object of the present invention to develop a receptacle of the aforementioned type in such a manner that the negative pressure is reduced which prevails in the inner bag after the discharge of filling substance.

This object is achieved according to the invention by the features of patent claim 1.

Advantageous developments of the present invention are characterized in the dependent claims.

When viewed in circumferential direction of the receptacle, at least one pressure compensating opening is respectively formed at the two sides of the bottom weld seam in the outer receptacle in the receptacle of the invention, with all of the pressure compensating openings being offset with respect to the points of intersection of the bottom weld seam (or the extension thereof) with the circumferential wall of the outer receptacle. It is here preferred that the pressure compensating openings are offset by about 90° with respect to the points of intersection, though the invention is not limited to such a configuration.

This has the effect that the inner bag no longer detaches from the outer receptacle on four portions that are offset with respect to each other by about 90°, but a so-called "dog bone form" is obtained upon contraction of the inner bag during which the inner bag only lifts off on two opposite portions from the wall of the outer receptacle whose center is offset by about 90° with respect to the aforementioned points of intersection. This means that the inner bag is compressed at both sides to become more and more flat, with the center axis of the compressed cross-sectional form approximately coinciding with the clamped bottom seam of the inner bag.

Such a contraction of the inner bag which is no longer observed starting from four sides, but only from two sides, has the effect that the negative pressure prevailing in the inner bag is considerably reduced in comparison with a lifting off on more than two portions. What is reduced is both the collapsing force which contracts the bag into the "dog bone form", and the negative pressure which maintains such a form.

As a consequence, permeation into the inner bag decreases, the risk of leakage is reduced and the amount that remains in the inner bag and cannot be discharged becomes less.

It goes without saying that the contraction of the inner bag which is just created from two sides can be initiated not only by the measure that pressure compensating openings are formed that are exactly offset by 90° relative to said points of intersection. Rather, these openings may be located within a circumferential portion which in the individual case depends, for instance, on the material of the inner bag and the wall thickness thereof, and which is offset relative to the points of intersection, for instance by two respective pressure compensating openings that are spaced apart from each other in circumferential direction and can be offset in pairs by about 80° with respect to the points of intersection.

The essential feature is that when viewed in circumferential direction the pressure compensating openings in the receptacle according to the invention are no longer located within the narrow region formed by the points of intersection of the bottom weld seam with the circumferential wall, but are positioned, as much as possible, within a region offset by 90°, so that the inner bag—at least upon initial contraction —will no longer detach in the area of the points of intersection. This circumferential portion is preferably offset by 45° up to 135° relative to the points of intersection.

As already stated, the negative pressure can be minimized under otherwise identical conditions in that two diametrically opposite pressure compensating openings are arranged in a plane which is at a right angle with the plane extending through the bottom seam and the longitudinal center axis of the receptacle.

Of course, a plurality of pressure compensating openings can also be positioned one upon the other in spaced relationship on each side of the bottom weld seam.

These pressure compensating openings can be formed by elongated cuts made into the wall of the outer receptacle, such cuts being e.g. made by a knife, punching tool or with the help of a laser into the wall, and a remaining inner wall section being possibly torn up subsequently by applying a force. Such an operation can e.g. be carried out in the case of a receptacle whose outer wall has a wall thickness of about 0.7 to 0.9 mm in such a manner that a knife guided along a circular path produces a sickel-shaped cut or incision which severs the wall, except for a residual wall thickness of about 0.2 mm which remains for safety reasons and ensures that despite the occurrence of tolerances the inner bag cannot be damaged. Subsequently, a plunger, for instance, is pressed against the outer wall at one side of the cut so vigorously that the remaining wall section bursts open. A pressure compensating opening can be formed in a similar manner with a punching tool or with a laser.

The pressure compensating openings can also be formed by point-shaped holes or punctures formed or made in the wall of the outer receptacle, with the puncturing or piercing needle being possibly provided with a central hole which communicates with a source of pressurized medium. When the puncturing or piercing needle passes through the wall of the outer receptacle, the pressurized medium, which may e.g. be air, water or a gel, is pressed, at the moment at which the needle passes through the wall, from the wall of the outer receptacle so vigorously against the inner bag that said bag recedes, so that the inner bag cannot be damaged by the puncturing or piercing needle.

Very small capillary openings which can be formed in the above-described manner at the desired points of the outer receptacle are sufficient for pressure compensation.

The receptacle according to the invention can evidently be a so-called wide-necked receptacle because the pressure compensating openings can be formed not only in the shoulder portion, but at any desired location of the outer receptacle.

The invention will now be described in more detail hereinafter with reference to the drawing, in which.

Figure 1:
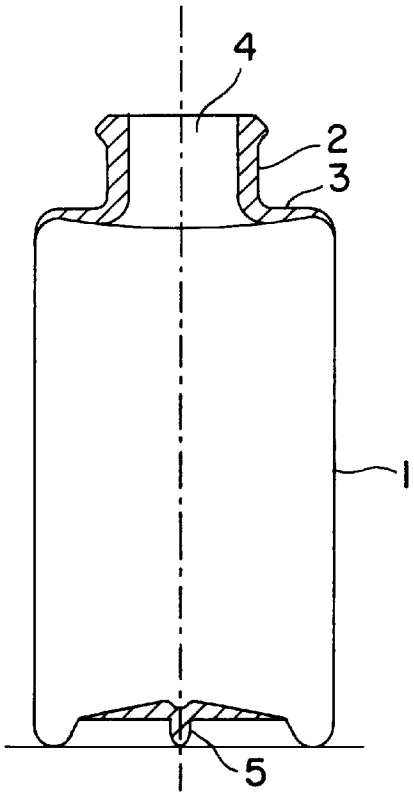
FIG. 1 is a vertical section through a receptacle of the type in question which has been produced in a coextrusion-type blow molding process.

The receptacle which is shown in FIG. 1 includes a receptacle neck 2 and a shoulder section 2. The receptacle opening 4 may have attached thereto a pump for discharging the receptacle contents, without the invention being limited to such a configuration. The receptacle can also be designed as a squeeze type bottle in which the receptacle wall is squeezed by hand for discharging the receptacle contents, and the receptacle may also be a so-called wide-necked receptacle without any shoulder section.

At the bottom of the receptacle, preferably due to the fact that the blow mold has been closed, there is formed a projecting web 5 which when viewed in cross-section is approximately shaped as a kite and has a portion, in the figure a lower portion, in which the material layers of the outer receptacle 6 (see FIG. 3) contact each other because the two squeezed-off material layers of the inner bag 7 have slightly receded upwards in the molded cavity of the web from the separation point. The weld seam of the inner bag which has been formed during the squeeze-off operation is clamped in the upper portion of the web 5 and thus held in axial direction.

Figure 2:
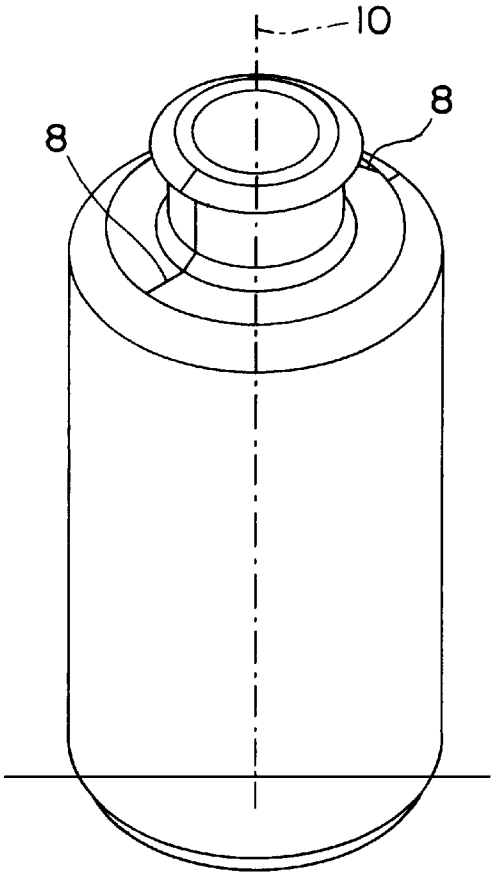
FIG. 2 is a perspective view of a known receptacle having open shoulder seams.

FIG. 2 shows a known receptacle in which the pressure compensation required for discharging the receptacle contents is carried out in the space existing between the outer receptacle and the inner bag by open shoulder seams 8 of the outer receptacle 6 which are formed in said portion by a smooth, webless squeeze-off operation of the blow mold.

The open shoulder seams 8 are here located in the vertical plane which extends through the axis of the web 5 and the central longitudinal axis 10 of the receptacle. The points of intersection of said plane 9 with the circumferential wall of the outer receptacle 6 are designated in FIG. 3 by the reference numeral 11.

While the receptacle contents is being discharged, the inner bag 7 detaches from the inner wall of the outer receptacle on four portions that become increasingly greater, namely on the portions 12 surrounding the points of intersection 11, on which when viewed in the circumferential direction of the receptacle, air enters for the purpose of pressure compensation, and on portions 13 which are offset with respect thereto by about 90°. This has the effect that a star-shaped contraction form of the inner receptacle is obtained.

Contracting the inner receptacle 7 from four sides requires a relatively great collapsing force which corresponds to an also relatively great negative pressure in the inner bag for maintaining said contraction form. The consequences are a relatively great permeation, the risk of leakage of the inner bag 7 and a relatively great residual amount which cannot be discharged from the inner bag.

Figure 4:
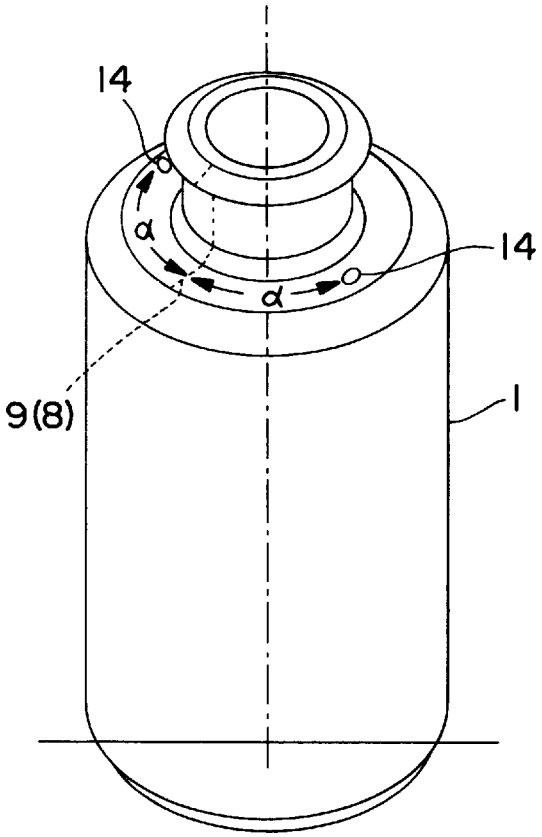
FIG. 4 is a perspective view of a receptacle of the invention in an illustration corresponding to FIG. 2.
Figure 5:
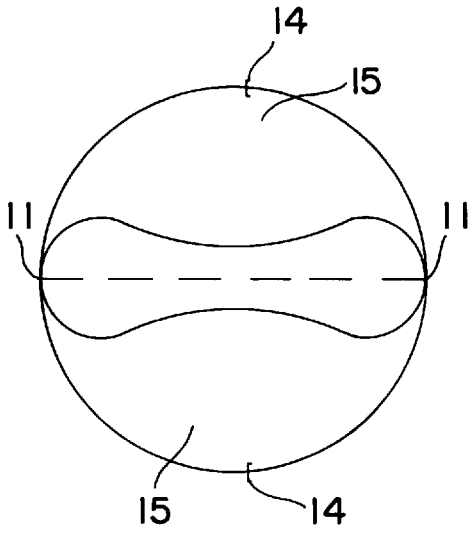
FIG. 5 shows a horizontal section through the receptacle shown in FIG. 4 in an illustration corresponding to FIG. 3.

FIG. 4 shows a receptacle 1 according to the invention in an illustration corresponding to FIG. 2. This receptacle does not contain any open shoulder seams for pressure compensation, but two pressure compensating openings 14, which are marked in FIG. 5 in a purely schematic manner, at locations which are offset with respect to plane 9 or the position of the open shoulders 8 according to FIG. 2 by an angle $\alpha$ of 90° in each case.

Figure 3:
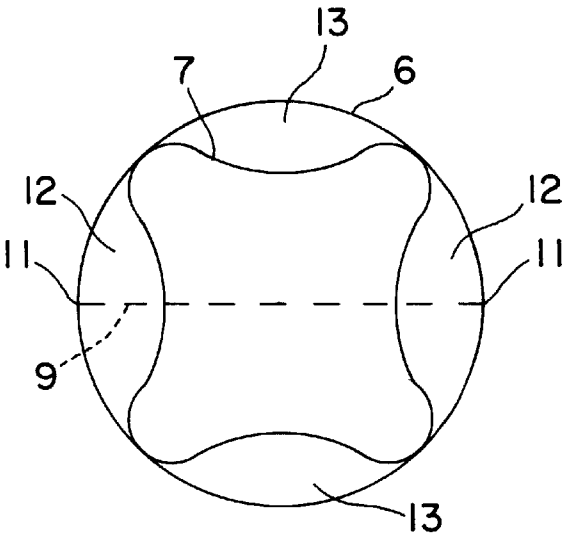
FIG. 3 shows a horizontal section through the receptacle according to FIG. 2 above the clamped bottom seam of the inner bag in a state in which the inner bag has been contracted.

Since pressure compensating openings are absent in the area of the points of intersection 11, the inner bag 7 does not detach from the inner wall of the outer receptacle 6 when the receptacle contents is discharged, i.e. there are no contraction sections 12 of the star-shaped contraction according to FIG. 3. The inner bag 7 just contracts from two sides, with such an area expanding more and more around the pressure compensating openings 14 and being marked in FIG. 5 with the reference numeral 15. A so-called "dog bone form" which is created by the inner bag being contracted becomes more and more pronounced.

Such a contraction of the inner bag which only starts from two sides has the effect that it only requires a small collapsing force, which is tantamount to a smaller negative pressure for maintaining the contracted form. As a result, permeation is reduced, and also the risk of leakage, and there is only a small residual amount that cannot be discharged.

It should be noted that a contraction which only takes place at two sides can of course not only be initiated by the pressure compensating openings being exactly offset by 90° with respect to the points of intersection 11. It is important that there are no pressure compensating openings within the circumferential portion close to the points of intersection 11, such openings possibly causing a lifting off of the inner bag 7 from the wall of the outer receptacle 6 in this area. A contraction at two sides can of course also be achieved in that at both sides of the pressure compensating openings 14 further pressure compensating openings are formed which, however, must keep a sufficient circumferential distance from the points of intersection 11.

What is claimed is:

1. A receptacle produced in a coextrusion-type blow molding process, which consists of a substantially stiff outer receptacle and an easily deformable inner bag which are made from respectively different thermoplastic materials that do not form a welded joint with one another, said receptacle comprising a receptacle opening including at least two pressure compensating openings provided in the wall of said outer receptacle for pressure compensation within the space existing between the outer receptacle and the inner bag upon contraction of said inner bag, with the inner bag being closed by a bottom weld seam when excess material is squeezed off at the bottom of a blow mold, and said bottom weld seam being clamped in a bottom weld seam of the outer receptacle that is also closed, characterized in that at least one pressure compensating opening (14) is formed at both sides of said bottom weld seam (5), and that all of said pressure compensating openings (14) are formed at places of said outer receptacle (6) that are offset in circumferential direction relative to the points of intersection (11) of said bottom weld seam (5) with the circumferential wall of said outer receptacle (6).

2. A receptacle according to claim 1, characterized in that at least one respective pressure compensating opening (14) is offset by about 90° relative to the points of intersection (11).

3. A receptacle according to any one of claims 1 or 2, characterized in that at least two pressure compensating openings are respectively arranged one upon the other in spaced-apart relationship, being offset by about 90° with respect to said points of intersection (11).

4. A receptacle according to any one of claims 1, characterized in that said pressure compensating openings (14) are formed by elongated cuts made into the wall of said outer receptacle (6).

5. A receptacle according to any one of claims 1, characterized in that said pressure compensating openings (14) are formed by point-shaped holes or punctures made in the wall of said outer receptacle (6).

* * * * *